US007914312B1

(12) United States Patent
Huang

(10) Patent No.: US 7,914,312 B1
(45) Date of Patent: Mar. 29, 2011

(54) CONNECTOR HAVING A SUPPORT BOARD MOVING UPWARD TO ENSURE CONTACT BETWEEN A FLEXIBLE CIRCUIT BOARD CONTACTS AND ELECTRICAL TERMINALS

(75) Inventor: Sheng-Yuan Huang, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/796,663

(22) Filed: Jun. 8, 2010

(51) Int. Cl.
*H01R 13/62* (2006.01)

(52) U.S. Cl. ..... 439/329

(58) Field of Classification Search ..... 439/329, 439/260, 342, 343, 345, 495, 67
See application file for complete search history.

(56) References Cited

U.S. PATENT DOCUMENTS 5,562,472 A * 10/1996 Dubois et al. ..... 439/329
6,224,418 B1 * 5/2001 Miura et al. ..... 439/495
6,299,469 B1 * 10/2001 Glovatsky et al. ..... 439/329
6,379,176 B1 * 4/2002 Ohsawa et al. ..... 439/495
6,383,017 B1 * 5/2002 Takayasu ..... 439/495
6,790,074 B1 * 9/2004 Chiu ..... 439/495
7,029,320 B2 * 4/2006 Maejima ..... 439/495
7,165,991 B2 * 1/2007 Sato et al. ..... 439/492
D595,655 S * 7/2009 Huang et al. ..... D13/147
2002/0028605 A1 * 3/2002 Takayasu ..... 439/625

* cited by examiner

*Primary Examiner* — Chandrika Prasad

(57) ABSTRACT

A connector includes an insulating housing defining a receiving recess for receiving a flexible printed circuit board and a pair of receiving cavities located at two sides of the receiving recess, a plurality of electrical terminals disposed in the insulating housing, and a slidable cover mounted to the insulating housing and having a base board. A portion of the base board is recessed downward to form a gap and an inmost edge of the gap extends to form a supporting board. Two opposite ends of the base board extend to form a pair of fixing arms. A front portion of each of the fixing arms is protruded downward to form a sliding block. The slidable cover is pushed to the insulating housing with the sliding blocks sliding into the receiving cavities that drives the supporting board moving upward so that ensure a firm contact between the flexible printed circuit board and the electrical terminals.

7 Claims, 6 Drawing Sheets

(1)

(2)

(1)

(2)

CONNECTOR HAVING A SUPPORT BOARD MOVING UPWARD TO ENSURE CONTACT BETWEEN A FLEXIBLE CIRCUIT BOARD CONTACTS AND ELECTRICAL TERMINALS

BACKGROUND OF THE INVENTION

1. Field of the Invention

The present invention generally relates to an electrical connector, and more particularly to a connector for a flexible printed circuit (FPC hereinafter for simplification) board.

2. The Related Art

A traditional FPC connector includes an insulating housing, a plurality of terminals disposed in the insulating housing and an actuator. The actuator is pivotally mounted to the insulating housing and defines two pivoting portions pivoted in two opposite sides of the insulating housing so that the actuator can be opened or closed freely. After inserting an FPC board into the FPC connector, the actuator can rotate from an open position to a closed position. However, there always exists a distance between the pivoting portions of the actuator and the insulating housing, while at the closed position, the actuator is apt to move under shaking that causes the FPC board and the terminals electrically contact each other unsteadily. Moreover, the FPC board may be held between the insulating housing and the actuator without any fixtures, so the FPC board may slide out of the FPC connector when the FPC connector is under shaking. As a result, the electrical connection between the FPC board and the terminals is not steady.

SUMMARY OF THE INVENTION

An object of the present invention is to provide a connector adapted for receiving a longitudinally inserted flexible printed circuit board therein. The connector includes an insulating housing, a plurality of electrical terminals and a slidable cover. The insulating housing defines a receiving recess for receiving the flexible printed circuit board therein and a pair of receiving cavities at two sides of the receiving recess in a front surface thereof. The electrical terminals are disposed in the insulating housing and stretch into the receiving recess for contacting with the flexible printed circuit board. The slidable cover is mounted to the insulating housing and has a base board attached to the front surface of the insulating housing. A portion of the base board forms a gap corresponding to the receiving recess for allowing the flexible printed circuit board to be inserted therefrom. A supporting board is extended towards the insulating housing from a portion of the base board adjacent to an inmost edge of the gap for supporting the inserted flexible printed circuit board. Two opposite ends of the base board extend towards the same direction as the supporting board to form a pair of fixing arms located at two sides of the supporting board and spaced apart from the supporting board for being inserted into the corresponding receiving cavities. When free ends of the fixing arms are inserted into fronts of the corresponding receiving cavities, the flexible printed circuit board is inserted into the receiving recess from the gap and supported on the supporting board. After the flexible printed circuit board is inserted in the receiving recess, the fixing arms continue to slide rearward in the corresponding receiving cavities to make the fixing arms have an upward displacement by displacing structures formed between the corresponding the receiving cavities and the fixing arms. The fixing arms drive the supporting board to move upward so as to ensure a steady contact of the flexible printed circuit board contact and the electrical terminals.

As described above, when free ends of the fixing arms are inserted into fronts of the corresponding receiving cavities, the flexible printed circuit board is inserted into the receiving recess from the gap and supported on the supporting board. And then, the fixing arms continue to slide rearward in the corresponding receiving cavities to make the fixing arms have an upward displacement by displacing structures formed between the corresponding the receiving cavities and the fixing arms. The fixing arms further drive the supporting board to move upward so as to ensure a steady electrical connection of the flexible printed circuit board contact and the electrical terminals.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
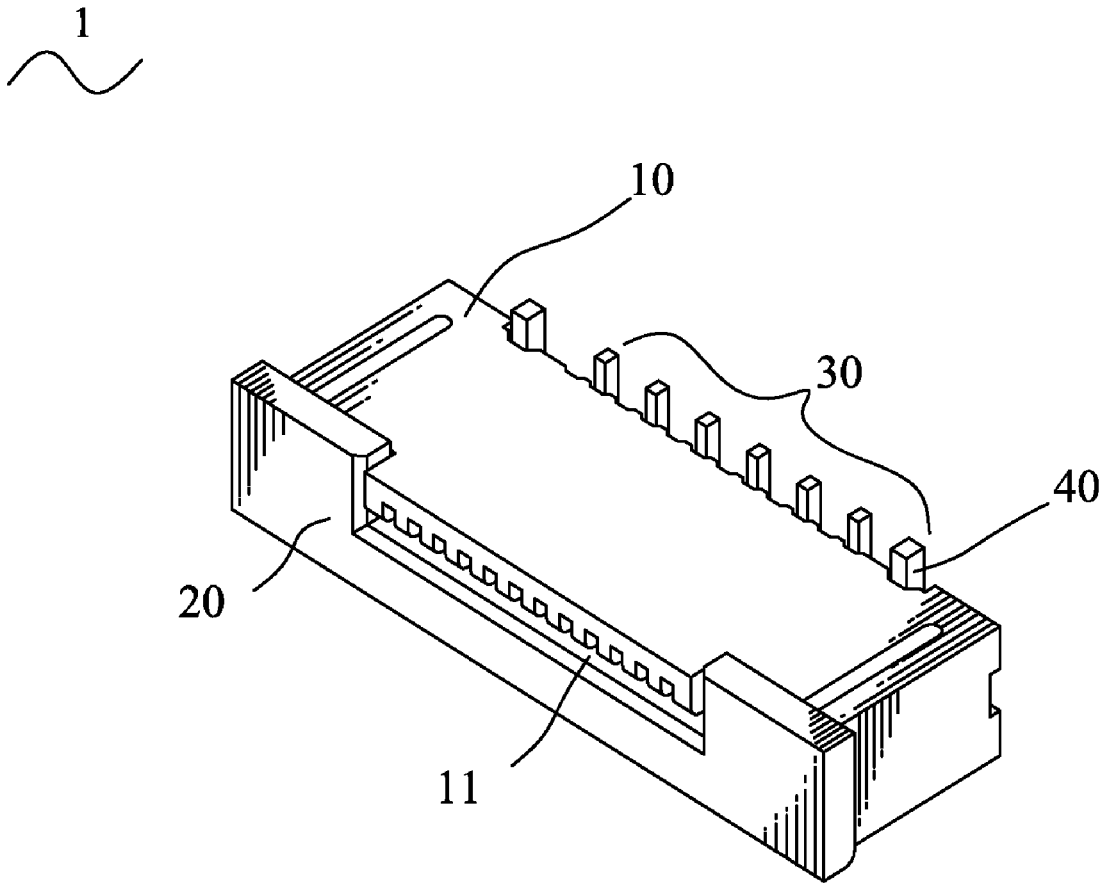
FIG. 1 is a perspective view of an FPC connector in accordance with the present invention.
Figure 2:
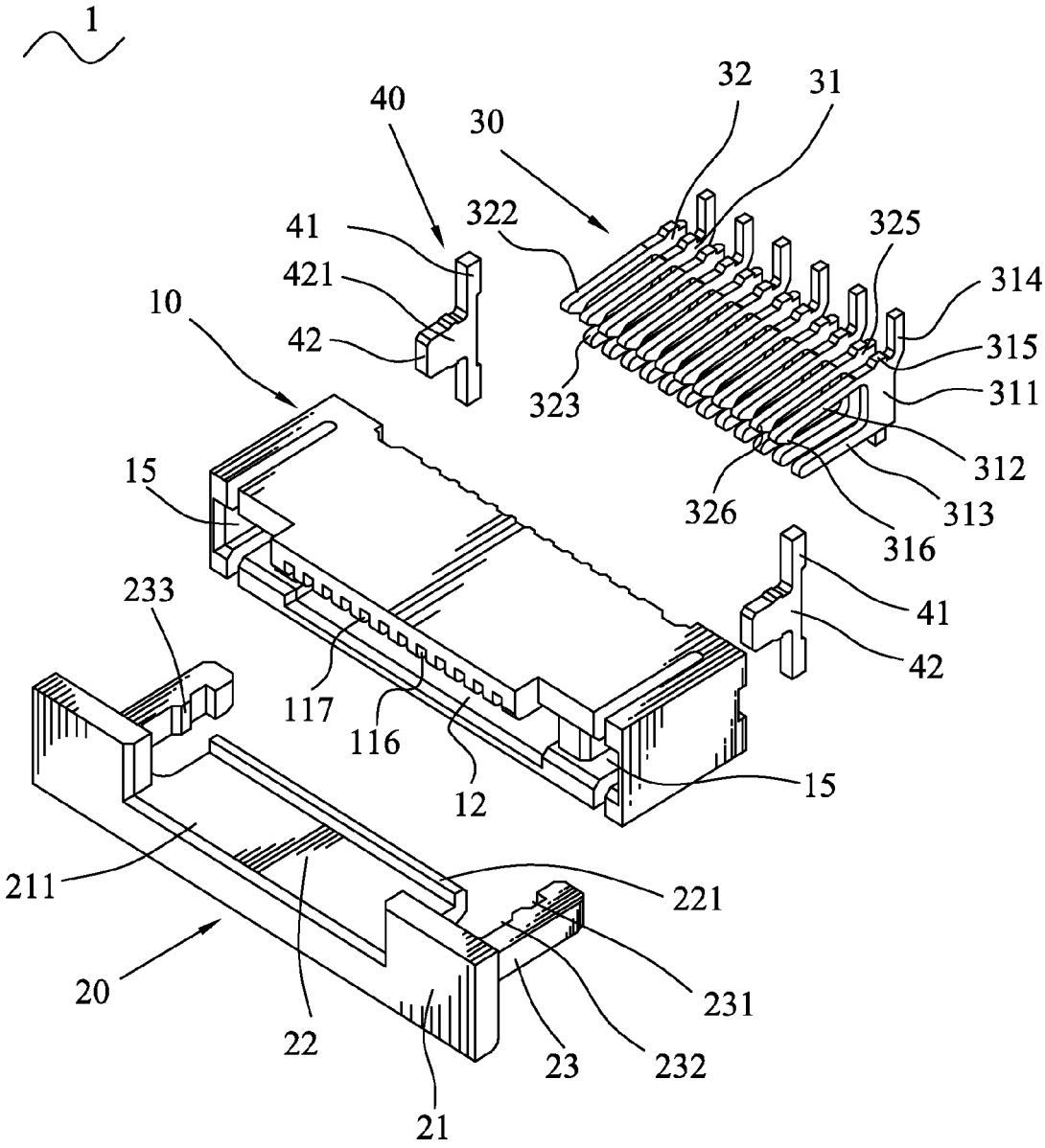
FIG. 2 is an exploded view of the FPC connector of FIG. 1.
Figure 3:
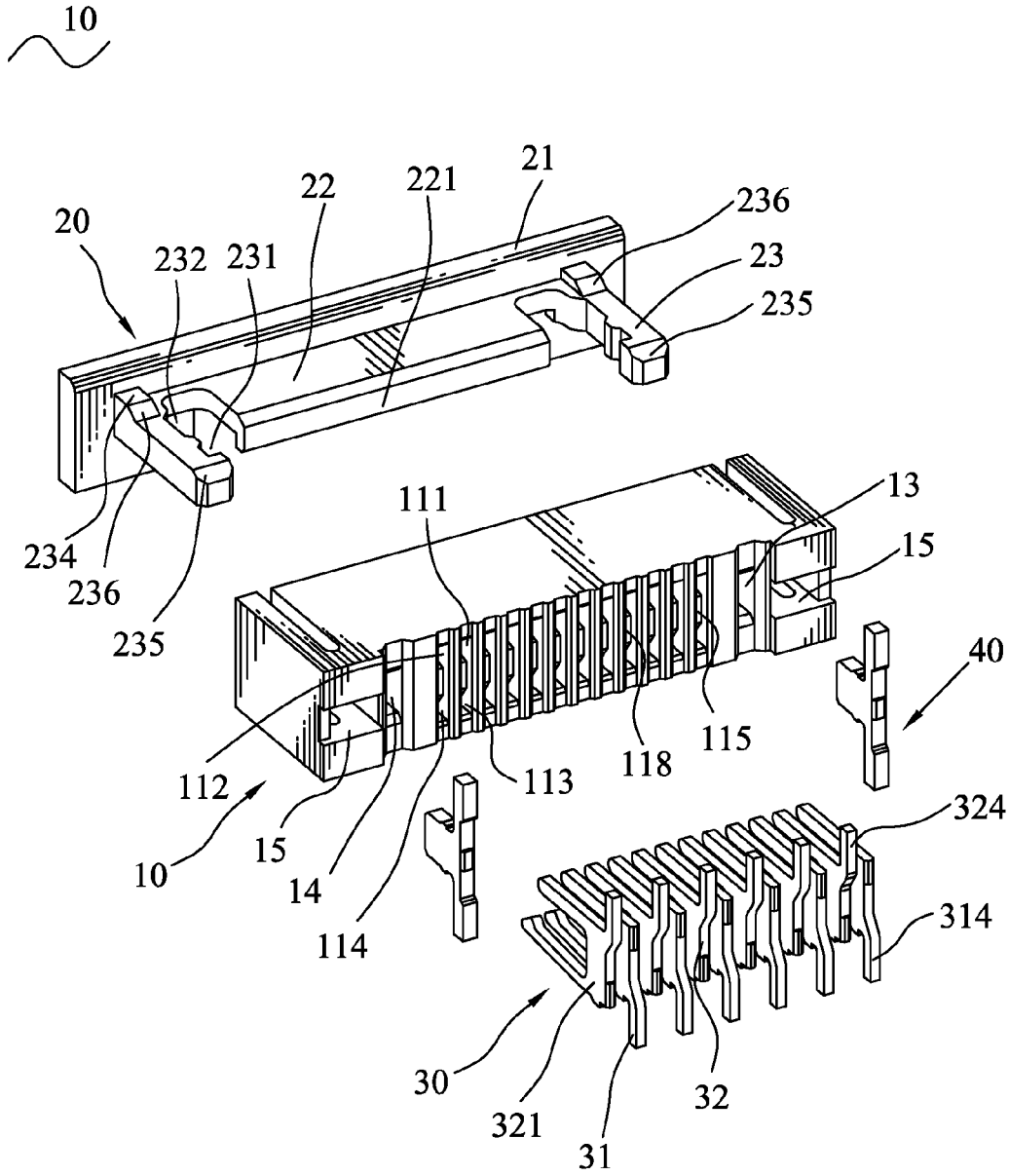
FIG. 3 is another exploded view of the FPC connector of FIG. 1 from another direction.
Figure 4:
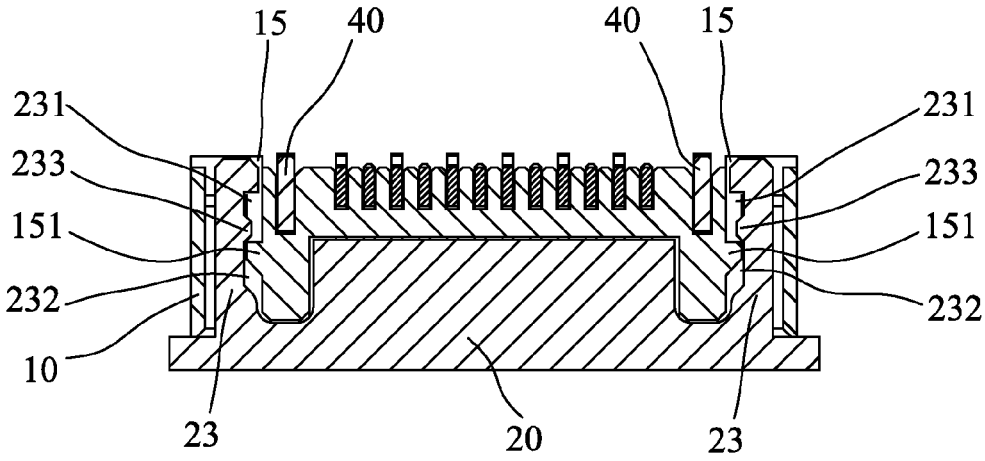
FIG. 4 is a top sectional view of the FPC connector of FIG. 1, when a slidable cover is partially assembled with an insulating housing of the FPC connector.
Figure 5:
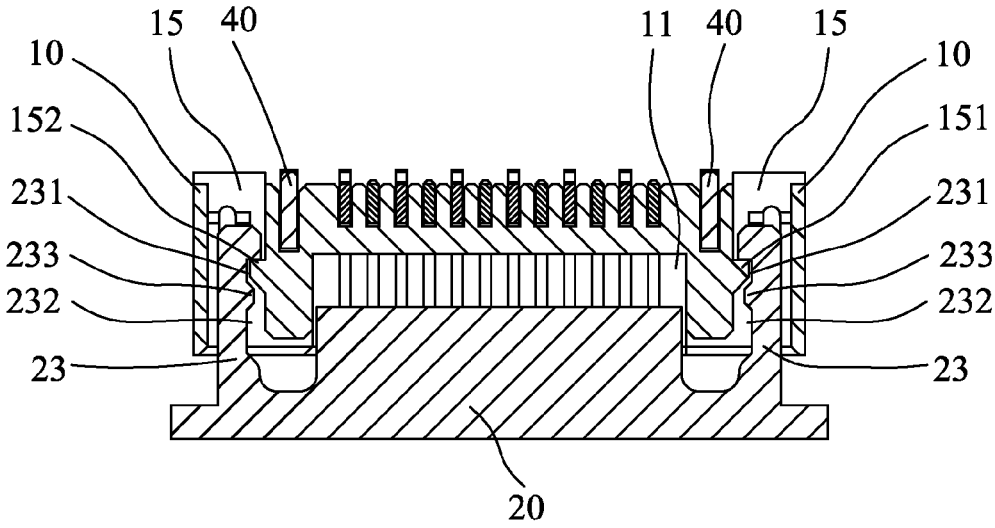
FIG. 5 is another top sectional view of the FPC connector of FIG. 1, when the slidable cover is fully assembled with the insulating housing of the FPC connector.
Figure 6:
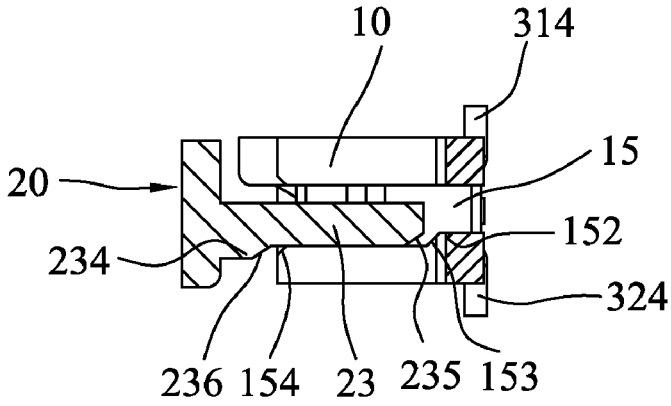
FIG. 6 is lateral sectional views of the slidable cover mounted on the insulating housing of the FPC connector, showing two statuses of the slidable cover partially assembled with the insulating housing and the slidable cover fully assembled with the insulating housing.
Figure 6:
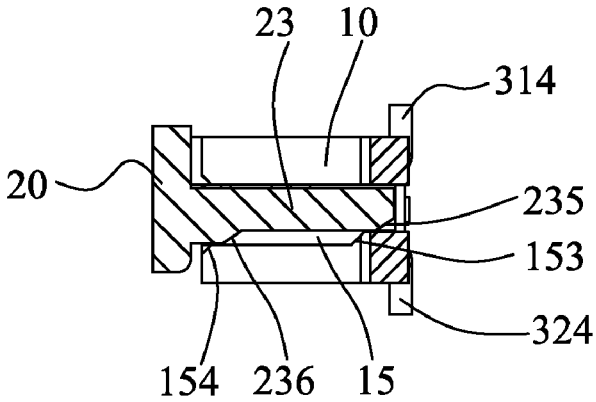

Referring to FIG. 1 and FIG. 2, an FPC connector 1 according to the present invention is shown. The FPC connector 1 includes an insulating housing 10, a slidable cover 20 mounted to the insulating housing 10, a plurality of electrical terminals 30 and a pair of fastening members 40 disposed in the insulating housing 10 respectively.

Figure 7:
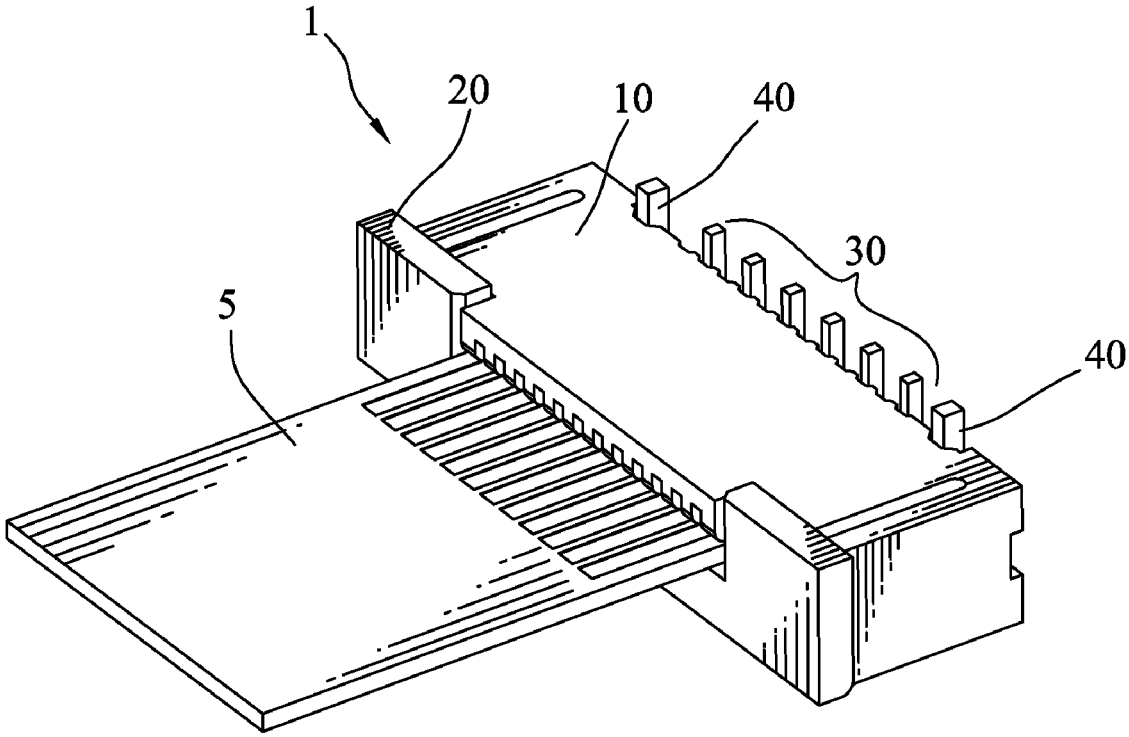
FIG. 7 is another perspective view of the FPC connector of FIG. 1, in which an FPC board is inserted.

Referring to FIGS. 1-6, the insulating housing 10 is of substantially rectangular shape and disposed levelly. The insulating housing 10 defines a rectangular receiving recess 11 extending transversely and passing through a front surface 12 thereof to receive an FPC board 5 therein (shown in FIG. 7). Upper portions of a rear wall of the receiving recess 11 are recessed rearward to form a plurality of first passageways 111 and a plurality of second passageways 112 alternately arranged at regular intervals along a transverse direction thereof and each extending longitudinally to pass through a rear surface 13 of the insulating housing 10. Lower portions of the rear wall of the receiving recess 11 are recessed rearward to form a plurality of first receiving grooves 113 and a plurality of second receiving grooves 114 alternately arranged at regular intervals along a transverse direction thereof and each extending longitudinally to pass through the rear surface 13 of the insulating housing 10. The first receiving grooves 113 and the second receiving grooves 114 correspond to the first passageways 111 and the second passageways 112, respectively. A plurality of first and second connecting slots 115, 118 are formed in the rear surface 13 of the insulating housing 10 each extending vertically to connect the corresponding first passageways 111 and the corresponding first receiving grooves 113, the corresponding second passageways 112 and the corresponding second receiving grooves 114, respectively. A top wall of the receiving recess 11 defines a plurality of first fixing slots 116 and a plurality of second fixing slots 117 alternately arranged at regular intervals along a transverse direction thereof to respectively communicate with the corresponding passageways 111, 112.

A pair of rectangular holding grooves 14 are formed at two sides of the rear surface 13 of the insulating housing 10, respectively, with the connecting slots 115, 118 located therebetween. The insulating housing 10 further defines a pair of rectangular receiving cavities 15 located at two sides of the receiving recess 11 and with the holding grooves 14 located therebetween. Each of the receiving cavities 15 extends longitudinally to pass through the front surface 12 and the rear surface 13 of the insulating housing 10 respectively. A portion of a side wall of the receiving cavity 15 is protruded inwardly to form a projection 151. A rear portion of a bottom wall of the receiving cavity 15 is protruded upward to form a substantially rectangular supporting block 152. A first guiding surface 154 is formed to smoothly connect the bottom wall of the receiving cavity 15 and a front surface 12 of the insulating housing 10. A second guiding surface 153 is formed to smoothly connect a front part of the supporting block 152 to the bottom wall of the receiving cavity 15.

Referring to FIGS. 1-6 again, the slidable cover 20 has a substantially rectangular base board 21. A substantially middle of a side the base board 21 is cut to form a rectangular gap 211 extending transversely corresponding to the receiving recess 11 of the insulating housing 10. A rectangular and transverse supporting board 22 is extended perpendicularly from a portion of the base board 21 adjacent to an inmost edge of the gap 211 A rear end of the supporting board 22 is bent a little to form a preventing board 221 facing the gap 211. Two opposite ends of the base board 21 extend rearward to form a pair of fixing arms 23 beyond the supporting board 22. The supporting board 22 is located between the fixing arms 23 and spaced apart from the fixing arms 23. An inner surface of each of the fixing arms 23 which is adjacent to the supporting board 22 defines a first locating groove 231 adjacent to a free end of the corresponding fixing arm 23 and a second locating groove 232 adjacent to the base board 21, a lump 233 formed between the first and second locating grooves 231, 232. A portion of the fixing arm 23 adjacent to the base board 21 is protruded towards a direction opposite to the preventing board 221 to form a sliding block 234. The thickness of the sliding block 234 is substantially the same as that of the supporting block 152 so as to keep balance when the FPC board 5 is fully inserted into the insulating housing 10. One end of the sliding block 234 is connected with the base board 21, the other end of the sliding block 234 forms a first slope 236 to connect with the fixing arm 234. A second slope 235 is formed at a lower corner of a free end of the fixing arm 23.

Referring to FIGS. 1-4, the electrical terminals 30 includes a plurality of first electrical terminals 31 and a plurality of second electrical terminals 32. Each of the first electrical terminals 31 has a first connecting plate 311 extending vertically. Two opposite ends of the first connecting plate 311 are bent towards the same direction to form a first contact arm 312 and a first lower arm 313. The first contact arm 312 and the first lower arm 313 are spaced from parallel to each other. The end of the first connecting plate 311 from which the first contact arm 312 is extended extends outward to form a first soldering portion 314 biased from the first connecting plate 311 and a first fixing portion 315 located between the first soldering portion 314 and the first contact arm 312. A free end of the first contact arm 312 is protruded towards the first lower arm 313 to form a first contact lump 316.

Referring to FIGS. 1-4 again, each of the second electrical terminals 32 has a second connecting plate 321. Two opposite ends of the second connecting plate 321 are bent towards the same direction to form a second contact arm 322 and a second lower arm 323. The second contact arm 322 and the second lower arm 323 are spaced from and parallel to each other. The end of the second connecting plate 321 from which the second lower arm 323 is extended extends outward to form a second soldering portion 324 biased from the second connecting plate 321. The end of the second connecting plate 321 from which the second contact arm 322 is extended is protruded outward to form a second fixing portion 325. A free end of the second contact arm 322 is protruded towards the second lower arm 323 to form a second contact lump 326.

Referring to FIGS. 1-4, each of the fastening members 40 has a base bar 41 extending vertically. A substantially middle portion of the base bar 41 extends forward to form a retention portion 42. The base bar 41 and the retention portion 42 cooperate to show a substantial T shape. A plurality of teeth 421 are formed at two opposite side edges of the retention portion 42.

Referring to FIGS. 1-6, in assembly, the first electrical terminals 31 are inserted forward with the first connecting plates 311 being inserted into the corresponding first connecting slots 115 of the insulating housing 10, rear portions of the first contact arms 312 being fastened in the corresponding first passageways 111, front portions of the first contact arms 312 being fastened in the corresponding first fixing slots 116, rear portions of the first lower arm 313 being received in the corresponding first receiving grooves 113 and front portions of the first lower arms 313 stretching into the receiving recess 11 and under the first contact arms 312. The first soldering portions 314 are exposed out of a top of the insulating housing 10 for being soldered with a printed circuit board (not shown). The first fixing portions 315 are abutted against corresponding inner walls of the corresponding first passageways 111 for forming a firmer connection between the insulating housing 10 and the first electrical terminals 31. The second electrical terminals 32 are inserted forward with the second connecting plates 321 being inserted into the corresponding second connecting slots 118 of the insulating housing 10, rear portions of the second contact arms 322 being fastened in the corresponding second passageways 112, front portions of the second contact arms 322 being fastened in the corresponding second fixing slots 117, rear portions of the second lower arm 323 being received in the corresponding second receiving grooves 114 and front portions of the second lower arms 323 stretching into the receiving recess 11 and under the second contact arms 322. The second soldering portions 324 are exposed out of a bottom of the insulating housing 10 for being soldered with the printed circuit board. The second fixing portions 325 are abutted against corresponding inner walls of the corresponding second receiving grooves 114 for forming a firmer connection between the insulating housing 10 and the second electrical terminals 32. The first soldering portions 314 and the second soldering portions 324 are alternately arranged at the rear of the insulating housing 10 so as to strengthen the soldering between the FPC connector 1 and the printed circuit board. The fastening members 40 are inserted forward with the base bars 41 inserted into the corresponding holding grooves 14 and the retention portion 42 abutting against the rear surface 13 of the insulating housing 10. Two ends of the base bar 41 are soldered with the printed circuit board. The teeth 421 are abutted against inner surfaces of the holding groove 14 for forming a firmer engagement between the fastening member 40 and the insulating housing 10. The slidable cover 20 is mounted to the insulating housing 10 with the fixing arms 23 inserted into the corresponding receiving cavities 15, the supporting board 22 stretching into the receiving recess 11 and the base board 21 abutting against the front surface 12 of the insulating housing 10.

Referring to FIGS. 1-7 again, in use, the slidable cover 20 is pushed rearward with the supporting board 22 partially stretching into the receiving recess 11 and located between the contact arms 312, 322 and the lower arms 313, 323, and the fixing arms 23 being inserted into the corresponding receiving cavities 15. The fixing arms 23 slide along the corresponding receiving cavities 15 till the second slope 235 contacting with the second guiding surface 153 and the first slope 236 contacting with the first guiding surface 154, and in the meantime the projections 151 of the receiving cavities 15 are located in the corresponding first locating grooves 231 of the slidable cover 20. Then the FPC board 5 is inserted rearward into the receiving recess 11 of the insulating housing 10 through the gap 211 of the slidable cover 20 with a front end thereof being restricted by the preventing board 221 and part of the FPC board 5 located on the supporting board 22. Meantime, the FPC board 5 is non-contact with the contact lumps 316, 326 of the electrical terminals 31, 32. Then the slidable cover 20 is further pushed rearward to form an upward displacement of the supporting board 22 by means of the second slopes 235 sliding along the corresponding second guiding surfaces 153 and the first slopes 236 of the sliding blocks 234 sliding along the corresponding first guiding surfaces 154 till the base board 21 of the slidable cover 20 abutting against the front surface 12 of the insulating housing 10. Meantime, the projections 151 of the receiving cavities 15 slide into the corresponding second locating grooves 232 by way of the lumps 233, the free ends of the fixing arms 23 being located on the corresponding supporting blocks 152 and the sliding blocks 234 being located on the bottom walls of the corresponding receiving cavities 15 that drives the supporting board 22 to move upward for a distance so that make the FPC board 5 electrically contacting with the contact lumps 316, 326 of the electrical terminals 31, 32 more firmly.

When the FPC board 5 is to be withdrawn from the FPC connector 1, the slidable cover 20 is pulled forward to make the second slopes 235 sliding downward along the second guiding surfaces 153 and the first slopes 236 of the sliding blocks 234 sliding downward along the first guiding surfaces 154 to make the fixing arms 23 supported on the bottoms of the receiving cavities 15 again that drives the supporting board 22 to move downward for a distance for making the FPC board 5 be non-contact with the contact arms 312, 322 of the electrical terminals 30 so that make the FPC board 5 be withdrawn from the receiving recess 11 of the insulating housing 10 easily. And meantime the projections 151 of the receiving cavities 15 slide into the corresponding first locating grooves 231 of the slidable cover 20 by way of the lumps 233

As described above, when free ends of the fixing arms 23 are inserted into fronts of the corresponding receiving cavities 15, the FPC board 5 is inserted into the receiving recess 11 from the gap 211 and supported on the supporting board 22. And then, the fixing arms 23 continue to slide rearward in the corresponding receiving cavities 15 to make the fixing arms 23 have an upward displacement by the sliding blocks 234, the first slopes 236, the first guide surfaces 154, the supporting blocks 152, the second guiding surfaces 153 and the second slope 235*s* formed between the corresponding the receiving cavities 15 and the fixing arms 23. The fixing arms 23 further drive the supporting board 22 to move upward so as to ensure a steady electrical connection of the FPC board 5 and the electrical terminals.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector adapted for receiving a longitudinally inserted flexible printed circuit board therein, comprising:

an insulating housing defining a receiving recess for receiving the flexible printed circuit board therein and a pair of receiving cavities at two sides of the receiving recess in a front surface thereof;

a plurality of electrical terminals disposed in the insulating housing and stretching into the receiving recess for contacting with the flexible printed circuit board; and a slidable cover mounted to the insulating housing and having a base board attached to the front surface of the insulating housing, a portion of the base board forming a gap corresponding to the receiving recess for allowing the flexible printed circuit board to be inserted therefrom, a supporting board being extended towards the insulating housing from a portion of the base board adjacent to an inmost edge of the gap for supporting the inserted flexible printed circuit board, two opposite ends of the base board extending towards the same direction as the supporting board to form a pair of fixing arms located at two sides of the supporting board and spaced apart from the supporting board for being inserted into the corresponding receiving cavities, wherein when free ends of the fixing arms are inserted into fronts of the corresponding receiving cavities, the flexible printed circuit board is inserted into the receiving recess from the gap and supported on the supporting board, after the flexible printed circuit board is inserted in the receiving recess, the fixing arms continue to slide rearward in the corresponding receiving cavities to make the fixing arms have an upward displacement by displacing structures formed between the corresponding the receiving cavities and the fixing arms, the fixing arms drive the supporting board to move upward so as to ensure the contact of the flexible printed circuit board contact and the electrical terminals.

2. The connector as claimed in claim 1, wherein a front portion of each of the fixing arms adjacent to the base board is protruded downward to form a sliding block included by the displacing structure, before the flexible printed circuit board is inserted in the insulating housing, the sliding block is located outside the corresponding receiving cavity, after the flexible printed circuit board is inserted in the insulating housing, the sliding block is slided into the corresponding receiving cavity to move the fixing arm upward.

3. The connector as claimed in claim 2, wherein a first guiding surface is formed to connect a bottom wall of the receiving cavity and a front surface of the insulating housing, a first slope is formed at a rear end of the sliding block for cooperating with the first guiding surface to guide the insert of the sliding block, the displacing structure further includes the first guiding surface and the first slope.

4. The connector as claimed in claim 3, wherein a portion of a bottom wall of the receiving cavity protrudes upward to form a supporting block, a second guiding surface is formed to connect a front of the supporting block to the bottom wall of the receiving cavity, a second slope is formed at a bottom corner of the free end of the fixing arm, the second guide surface and the second slope guide the free end of the fixing arm to slide onto the supporting block, the displacing structure further includes the supporting block, the second guiding surface and the second slope.

5. The connector as claimed in claim 4, wherein the thickness of the sliding block is substantially the same as that of the supporting block.

6. The connector as claimed in claim 1, wherein a side surface of the fixing arm defines a first locating groove and a second locating groove in front of the first locating groove with a lump formed therebetween, a side wall of the receiving cavity protrudes inward to form a projection sliding into the corresponding second locating groove from the corresponding first locating groove by way of the corresponding lump.

7. The connector as claimed in claim 1, wherein a rear portion of the supporting board protrudes upward to form a preventing board for stopping the flexible printed circuit board.

* * * * *